United States Patent [19]

Yamaguchi et al.

[11] Patent Number: 4,878,961

[45] Date of Patent: Nov. 7, 1989

[54] METHOD AND SYSTEM FOR CONTROLLING TENSION TO BE EXERTED ON METAL STRIP IN CONTINUOUS ANNEALING FURNACE

[75] Inventors: Yasuhiro Yamaguchi; Yuji Shimoyama; Tateo Ohnishi; Hironobu Ohno, all of Chiba, Japan

[73] Assignee: Kawasaki Steel Corp., Japan

[21] Appl. No.: 102,875

[22] Filed: Sep. 30, 1987

[30] Foreign Application Priority Data

Sep. 30, 1986 [JP] Japan ..... 61-231579
Dec. 9, 1986 [JP] Japan ..... 61-292955

[51] Int. Cl.[4] ..... C21D 11/00

[52] U.S. Cl. ..... 148/128; 148/156; 266/80; 266/87; 266/90

[58] Field of Search ..... 148/128, 156; 266/78, 266/80, 90, 87–89, 102, 103, 111–113; 432/8, 59

[56] References Cited

U.S. PATENT DOCUMENTS

| | | | |
|---|---|---|---|
| 4,358,093 | 11/1982 | Shimoyama et al. | 266/103 |
| 4,371,332 | 1/1983 | Matsuo | 432/1 |
| 4,375,283 | 3/1983 | Shimoyama et al. | 266/44 |
| 4,571,274 | 2/1986 | Yanagishima et al. | 148/156 |
| 4,704,167 | 11/1987 | Ichida et al. | 148/153 |

FOREIGN PATENT DOCUMENTS

| | | | |
|---|---|---|---|
| 116325 | 7/1984 | Japan | 148/156 |
| 181242 | 9/1985 | Japan | 148/156 |
| 40728 | 9/1986 | Japan | 148/156 |
| 1243126 | 10/1986 | Japan | 148/156 |

*Primary Examiner*—Christopher W. Brody
*Attorney, Agent, or Firm*—Austin R. Miller

[57] ABSTRACT

An annealing operation is performed with controlling tension force to be exerted on a metal strip depending upon thermal crown of hearth rolls. The thermal crown magnitude is assumed based on various factors influencing for the magnitude of the effective crown.

35 Claims, 6 Drawing Sheets

METHOD AND SYSTEM FOR CONTROLLING TENSION TO BE EXERTED ON METAL STRIP IN CONTINUOUS ANNEALING FURNACE

BACKGROUND OF THE INVENTION

1. Field of the Invention

The present invention relates generally to a method and system for controlling tension to be exerted on a metal strip in a continuous annealing furnace for preventing the metal strip from meandering in the annealing furnace. More specifically, the invention relates to a technique of controlling tension on the metal strip in the continuous annealing furnace relative to thermal crown magnitude for suppressing meandering of the metal strip. The invention also relates to a tension control for annealing a very thin and flexible low-carbon metal strip or extra low-carbon steel strip.

2. Description of the Background Art

In general, continuous annealing of a series of metal strip is performed in a continuous annealing furnace which defines the path of the metal strip by means of a vertically offset plurality of hearth rolls. The series of metal strip passes a substantially long path in the annealing furnace with wrapping over the hearth rolls. When the metal strip offsets with respect to the center of the defined path, the offset magnitude can be amplified by the substantial length of the metal strip to cause substantial meandering of the metal strip in the furnace. This can cause breakage of the metal strip by contacting with the peripheral wall of the annealing furnace. Therefore, meandering of the metal strip has to be suppressed for stably performing a continuous annealing operation.

For this purpose, a crown is provided on the hearth rolls for automatically suppressing meandering of the metal strip by exerting a centering force. As a known technique, a taper crown which gradually reduces the diameter of the roll at both ends to a formed tapered profile at an end portion, and a round crown which reduces the diameter of the roll for forming a rounded profile at both ends of the roll, have been conventionally used. In these two types of crowns, a taper crown has been widely used because of ease of production and better centering performance. In the practical operation, the flexible metal strip tightly wraps on the periphery of the hearth roll. At this condition, a force arranged to transversely shift the metal strip toward the section having the larger diameter is exerted. This transverse force serves as a centering force for centering the metal strip. The magnitude of the centering force is variable depending upon the magnitude of tension exerted on the metal strip. Namely, the magnitude of the centering force to be exerted on the metal strip increases with increasing the magnitude of the tension to be exerted on the metal strip. This means that greater magnitude of tension force to be exerted on the metal strip may exhibit better strip centering performance. However, the tension to be exerted on the metal strip is limited in view of the strength of the metal strip to be annealed so that breakage or deformation of the metal strip may not occur.

On the other hand, by the centering force, the metal strip is centered to constantly pass the central portion of the hearth roll to form a cover for the central portion of the roll. Therefore, while wrapped by the metal strip in a heating zone and soaking zone in the annealing furnace, the central portion to the hearth roll may not be subject to the heat in the furnace. On the other hand, the transverse end sections where the crown is provided are constantly subject to the heat in the furnace. As a result, a difference of thermal expansion in the radial direction between the central portion and the end portions occurs. In this case, the thermal expansion at the end portions becomes much greater than that in the central portion. This difference of thermal expansion causes reduction of the magnitude of crown on the hearth roll to reduce the centering force to be exerted on the metal strip. When the difference of the thermal expansion becomes significant, a substantial change of roll crown is caused to result in meandering or heat buckling of the metal strip.

On the other hand, in the cooling zone, the central portion is constantly subject to high temperature heat transmitted from the metal strip to differentiate the temperature between the central portion and the end portion. Because of higher temperature at the central portion, thermal crown tends to be increased.

When the line speed of the metal strip in the annealing furnace changes significantly, the temperature at the central portion changes more quickly than the change at the end portion. Therefore, temperature distribution at the central portion and end portion of the hearth roll changes significantly to cause variation of the roll crown. When the crown magnitude is excessively increased by change of the line speed, heat buckling tends to occur. On the other hand, when crown magnitude is decreased by change of the line speed, meandering of the metal strip tends to occur.

For preventing the aforementioned problem, there have been proposed heating and/or cooling the hearth roll, or adjusting the crown magnitude by means of roll bending device. Such prior proposals have been disclosed in the Japanese Patent First (unexamined) Publication (Tokkai) Showa 57-177980 and the Japanese Utility Model First Publication (Jikkai) Showa 55-172859. However, in these cases, a substantial number of hearth rolls has to be adjusted for crown magnitude independently of each other. Therefore, in viewpoint of the cost, such prior proposal is not practically applicable for the actually working annealing furnace.

On the other hand, in annealing of substantially thin and flexible extra low carbon metal strip, prevention of the meandering and heat buckle is especially important. Particularly, in case of annealing metal strip such as a soft-temper tin plate, tin-free strip (TFS), which has a carbon content lower than or equal to 100 ppm. The crown of the hearth roll and the tension to be exerted on the strip has to be quite delicately controlled so as not to cause meandering and heat buckle.

SUMMARY OF THE INVENTION

Therefore, it is an object of the present invention to provide a method and system for controlling the tension force to be exerted on a metal strip in a continuous annealing furnace for preventing the metal strip from meandering and heat buckling.

Another object of the invention is to provide a method and system for controlling tension in a continuous annealing furnace which is applicable for continuous annealing of very thin and flexible extra low carbon metal strip.

In order to accomplish the aforementioned and other objects, an annealing operation is performed with the controlling tension force to be exerted on a metal strip depending upon thermal crown of hearth rolls. The thermal crown magnitude is assumed based on various factors influencing the magnitude of the effective crown.

On the other hand, in case of annealing of very thin and flexible extra low carbon metal strip, tension may also be adjusted according to the content of Ti and Nb.

According to one aspect of the invention, a system for controlling tension to be exerted on a metal strip in a continuous annealing furnace which includes a plurality of hearth roll for defining a path for the metal strip, comprises first means for exerting tension for the metal strip traveling through the continuous annealing furnace along the path, second means for monitoring a preselected operation parameter of the annealing furnace, which operation parameter affects variation of magnitude of effective roll crown on the hearth rolls, third means for deriving an assumed effective roll crown magnitude on the basis of the operation parameter as monitored by the second means, and fourth means for deriving an optimum tension range on the basis of the operation parameter, and controlling the first means for adjusting the tension to be exerted on the metal strip so that the tension to be actually exerted on the metal strip can be maintained within the optimum tension range.

According to another aspect of the invention, a system for controlling tension for a continuous annealing furnace which includes a plurality of hearth rolls for defining a path for the metal strip, comprises first means for exerting tension on the metal strip traveling through the continuous annealing furnace along the path, second means for monitoring a preselected operation parameter of the annealing furnace, which operation parameter affects variation of magnitude of effective roll crown on the hearth rolls, third means for deriving an assumed effective roll crown magnitude on the basis of the operation parameter as monitored by the second means, and fourth means for deriving an optimum tension range on the basis of the operation parameter, and controlling the first means for adjusting the tension to be exerted on the metal strip so that the tension to be actually exerted on the metal strip can be maintained within the optimum tension range, the fourth means deriving the optimum tension range for annealing an extra low carbon steel strip in relation to the effective crown magnitude of the hearth roll in such a manner that, when the tension to be exerted on the extra low carbon steel strip is y kg/mm$^2$ and the effective crown magnitude is x mm, the range is defined by lines illustrated by ($y_1=-0.5x+3$) and ($y_3=-0.2x+0.5$).

In the preferred construction, the first means comprises first, second and third bridle rolls, the first bridle roll being arranged at the entrance of the annealing furnace, the second bridle roll being arranged at the outlet of the annealing furnace and a third bridle roll being disposed within the annealing furnace and on the metal strip path, the first, second and third bridle rolls being cooperative with each other for adjusting the tension to be exerted on the metal strip, and the fourth means controls the rotation speed of the first, second and third bridle rolls for adjusting the tension within the optimum tension range. The third bridle roll is driven at a predetermined speed and the fourth means adjusts the rotation speeds of the first and second bridle rolls in relation to the rotation speed of the third bridle roll for maintaining the tension within the optimum tension range. The second means monitors the temperature within the annealing furnace as a parameter for causing thermal change of the roll crown, and the third means derives the assumed temperature distribution on various sections of the hearth roll on the basis of the monitored temperature and the line speed of the metal strip for assuming thermal change of roll crown magnitude.

Preferably, the second means further monitors the actual tension exerted on the metal strip traveling through the annealing furnace, the fourth means derives the optimum tension and compares criteria defining the optimum tension with the actual tension as monitored by the second means for adjusting the rotation speed of the first and second bridle rolls based on the difference between the optimum tension range indicative criteria and the actual tension. The system may further comprise fifth means for rotatingly driving the hearth rolls. The fourth means is cooperative with the fifth means for adjusting the tension of the metal strip within the optimum tension range in cooperation with the second means. The fifth means controls the rotation speed of the respective hearth rolls for adjusting the tension to be exerted on the metal strip. The fourth means derives the optimum tension range in view of the composition of the metal strip to be annealed.

The fourth means derives the optimum tension range for annealing an extra low carbon steel strip in relation to the effective crown magnitude of the hearth roll in such a manner that, when tension to be exerted on the extra low carbon steel strip is y kg/mm$^2$ and the effective crown magnitude is x mm, the range is defined by lines illustrated by ($y_1=0.5x+3$) and ($y_3=-0.2x+0.5$). The fourth means further defines the optimum tension range in relation to the effective crown magnitude of the hearth roll by criteria illustrated by ($y_4=0.25$) and ($x=-1$).

In the alternative, the fourth means modifies the optimum tension range for annealing the extra low carbon steel strip containing Ti or Nb to be defined by criteria illustrated by ($y_2=y_1-0.5$) and ($y_3=-0.2x+0.5$). The fourth means further defines the optimum tension range in relation to the effective crown magnitude of the hearth roll by criteria illustrated by ($y_4=0.25$) and ($x=-1$).

In the preferred embodiment, the annealing furnace is divided into a heating stage and a cooling stage, the second means monitors the operating parameters in the heating stage and cooling stage separately from each other, the third means derives the assumed effective roll crown magnitude of hearth rolls disposed in the heating stage and cooling stage separately from each other, and the fourth means controls the tension of the metal strip traveling in the heating stage and cooling stage independently of each other.

According to a further aspect of the invention, a method for controlling tension to be exerted on a metal strip in a continuous annealing furnace including a plurality of hearth rolls provided with a given magnitude of roll crown, comprises the steps of:

providing bridle rolls along the path of the metal strip:

driving the bridle rolls at respectively controlled speeds for exerting tension on the metal strip in the annealing furnace, the magnitude of which tension to be exerted on the metal strip being determined depending upon a difference of rotation speed of the bridle rolls;

monitoring a furnace operation parameter which affects the effective magnitude of the roll crown;

deriving the assumed effective roll crown magnitude on the basis of the monitored operation parameter;

deriving a target tension to be exerted on the metal strip so that the tension to be exerted on the metal strip is maintained within a predetermined relationship with the assumed roll crown magnitude; and controlling the rotation speed of the bridle rolls for adjusting the tension to be exerted on the metal strip toward the target tension.

The method may further comprise a step of monitoring the actual tension exerted on the metal strip, and the control of rotation speed of the bridle rolls is performed on the basis of the difference between the actual tension and the target tension so as to reduce the difference to zero. The rotation speed of the bridle rolls is determined with reference to a predetermined bridle roll.

The step of monitoring operation parameters includes monitoring temperature of the atmosphere in the annealing furnace and the line speed of the metal strip, and the assumed roll crown magnitude is derived on the basis of the monitored temperature and line speed.

BRIEF DESCRIPTION OF THE DRAWINGS

The present invention will be understood more fully from the detailed description of the invention and from the accompanying drawings of the preferred embodiment of the invention, which, however, should not be taken to limit the invention to the specific embodiments, but are for explanation and understanding only.

In the drawings

FIGS. 6(A), 6(B) and 6(C) are partial illustrations of the hearth roll, in which FIG. 6(A) shows an initial configuration of the hearth roll with an initial roll crown, FIG. 6(B) shows a hearth roll to be disposed within a heating zone or soaking zone in the continuous annealing furnace, and FIG. 6(C) is shown the hearth roll disposed within a cooling zone in the continuous annealing furnace;

DESCRIPTION OF THE PREFERRED EMBODIMENTS

Figure 1:
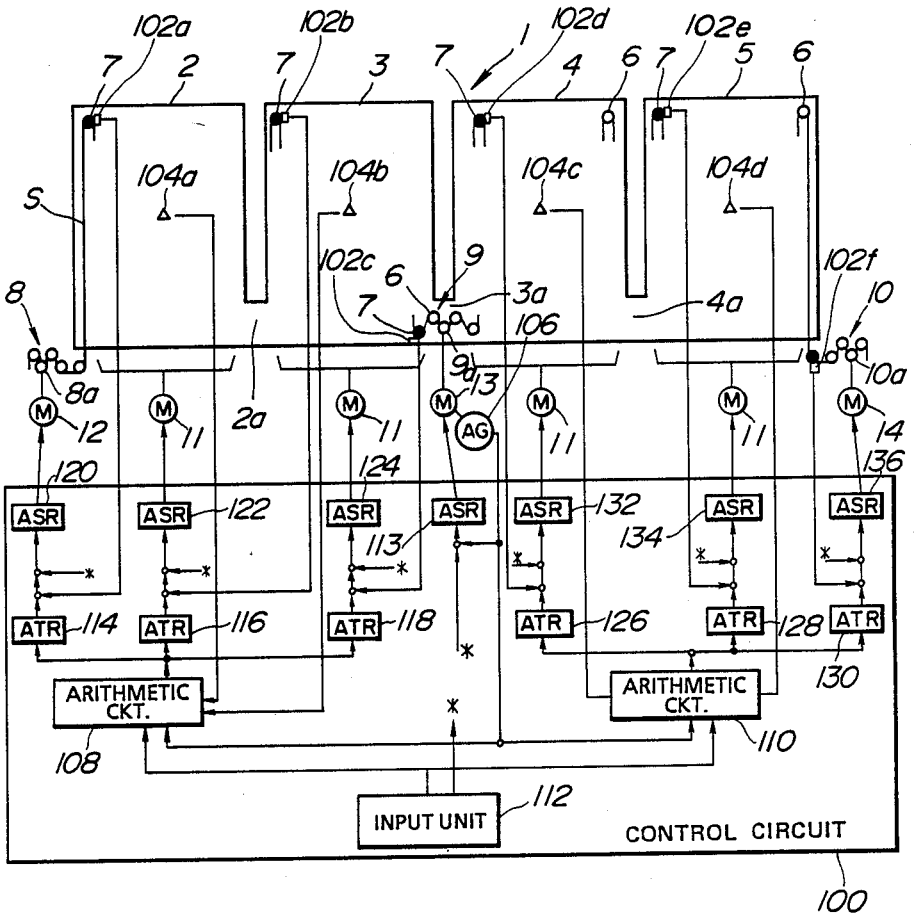
FIG. 1 is a diagrammatical illustration of a continuous annealing furnace associated with the preferred embodiment of a tension control system according to the invention, which tension control system is shown in a form of a block diagram.
Figure 2:
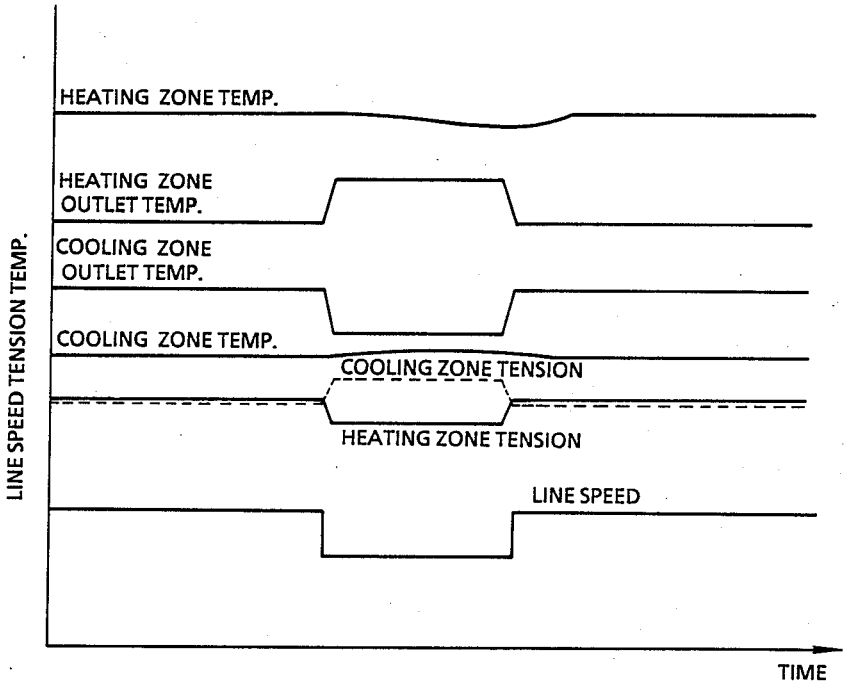
FIG. 2 is a chart showing variation of tension relative to variation of line speed.

Referring now to the drawings, the general construction of a continuous annealing furnace 1 is shown in FIG. 1. As is well known, the continuous annealing furnace is generally constituted by a heating zone 2, a soaking zone 3, a moderate cooling zone 4 and a rapid cooling zone 5. The heating zone 2 is oriented at the entrance 1*a* of the furnace 1 to heat a continuous metal strip S fed into the furnace to a predetermined temperature. In the soaking zone 3, the metal strip S is held at the predetermined temperature. Therefore, in the heating zone 2 and the soaking zone 3, there are provided known heating devices to maintain the temperatures. The moderate cooling zone 4 follows the soaking zone 3 for gradually or moderately cooling the metal strip according to a predetermined cooling pattern which is determined with respect to the target product. The metal strip past the moderate cooling zone is fed into the rapid cooling zone 5 to be cooled rapidly and fed out from the furnace through an outlet 1*b*. Communication paths 2*a*, 3*a* and 4*a* are formed for connecting respective zones 2, 3, 4 and 5. These communication paths 2*a*, 3*a* and 4*a* thus establish a series of metal strip paths throughout the continuous annealing furnace. Therefore, metal strip S is continuously fed through the annealing furnace to be subjected to annealing heat treatment through the furnace.

In the practical construction of the continuous annealing furnace, a leveling device and a looper may be provided upstream of the furnace. As is well known, the leveling device serves for flattening the metal strip by bending in a per se known manner. The looper is interposed between the leveling device and the entrance 1*a* of the annealing furnace 1 for compensating for variations of line speed upstream of the furnace.

As is well known, the metal strip S is fed, at first, into the heating zone 2 via a roll seal (not shown) provided at the inlet to be heated in the reductive atmosphere in the furnace chamber. A radiant tube burner or other heating device is provided in the heating zone heating the furnace chamber.

Another radiant tube burner or other heating device is also provided in the soaking zone 3 for evenly maintaining a section of the metal strip S at a predetermined temperature. In practice, the metal strip S is brought near the predetermined temperature in the heating zone 2. Therefore, the heating device in the soaking zone may merely provide enough heat to prevent temperature drop in the metal strip due to radiation of heat.

In order to adapt the heating cycle in the furnace, the respective heating devices in the heating zone 2, and soaking zone 3 are designed to be controlled according to the desired patterns of heat cycles.

Gas jets are provided at both sides of the metal strip path in the rapid cooling zone 5. The cooling gas from the gas jets is discharged onto both surfaces of the metal strip for cooling the metal strip to approximately 70° C. to 90° C.

A plurality of hearth rolls 6 are arranged within heating zone 2, the soaking zone 3, the moderate cooling zone 4 and the rapid cooling zone 5 for defining a metal strip path. As is well known, the hearth rolls are separated into two groups, one of which are oriented adjacent the ceiling of the furnace and the other is oriented adjacent the floor of the furnace. The hearth rolls arranged at the position close to the ceiling of the furnace may be hereafter referred to as "upper-side hearth rolls" and the hearth rolls located adjacent the floor of the furnace may be referred to as "lower-side hearth rolls". The metal strip S in the furnace is wrapped around the upper- and lower-side hearth rolls 6 alternatively to travel along a zig-zag path in the furnace.

Bridle roll assembly 8 is arranged immediately upstream of the entrance 1*a* of the furnace. Similarly, a bridle roll assembly 10 is arranged immediately downstream of the outlet 1*b* of the furnace. An additional bridle roll assembly 9 is disposed in the communication path 3*a*. The bridle roll assemblies 8, 9 and 10 respective include bridle roll 8*a*, 9*a* and 10*a*. The bridle rolls 8*a*, 9*a* and 10*a* are respectively associated with drive motors 12, 13 and 14 to be rotatingly driven at a controlled speed. In order to adjust the rotation speed of the associated bridle roll 8*a*, 9*a* and 10*a*, each of the driving motors 12, 13 and 14 are variable of revolution speed according to the driving voltage to be applied. As will be appreciated, the bridle roll assemblies 8 and 9 are cooperative with each other for adjusting the tension force to be exerted on the metal strip S in the heating zone 2 and the soaking zone 3. On the other hand, the bridle roll assembly 9 is also associated with the bridle roll assembly 10 for controlling the tension force to be exerted on the metal strip S in the moderated cooling zone 4 and the rapid cooling zone 5.

The hearth rolls 6 are also associated with driving motors 12 to be rotatingly driven at a controlled speed. The hearth rolls 6 as driven at the controlled speed are cooperative with the bridle roll assemblies 8, 9 and 10 for adjusting the tension force to exerted on the metal strip. Similarly to the motors 12, 13 and 14, the driving motors 11 are variable of revolution speed for adjusting the rotation speed of the hearth rolls 6 according to an electric voltage to be applied.

In order to control the driving speed of the motors 11, 12, 13 and 14, a control circuit 100 is provided. The control circuit 100 is connected to tension sensors 102*a*, 102*b*, 102*c*, 102*d*, 102*e* and 102*f* which are provided adjacent or on the same of the hearth rolls for monitoring the tension of the metal strip S. In the following disclosure, the tension sensors 102*a*, 102*b*, 102*c*, 102*d*, 102*e* and 102*f* will be represented by reference numeral "102" as generally referred to. Each of the tension sensors 102 produces a tension indicative sensor signal. The control circuit 100 is also connected to temperature sensors 104*a*, 104*b*, 104*c* and 104*d* disposed within respective heating zone 2, the soaking zone 3, the moderate cooling zone 4 and the rapid cooling zone 5 for monitoring the temperature of atmosphere in respectively associated zones, which temperature sensors as generally referred to by the reference numeral "104" in the following disclosure. Each of the temperature sensor 104 produces a temperature indicative sensor signal. In addition, the control circuit 100 is connected to a motor speed sensor 106 which monitors revolution speed of the motor 13. The motor speed sensor 106 produces a motor speed indicative sensor signal. Though the shown embodiment employs a single motor speed sensor, it would be possible to provide the same motor speed sensors for a plurality of motors or for all of the motors.

The control circuit 100 may be a computer-based circuit for processing preselected operation parameters to derive rotation speeds of the respective hearth rolls 6, bridle rolls 8*a*, 9*a* and 10*a* and the controlling tension force to be exerted on the metal strip. Herebelow discussed is a construction and operation of the control circuit 100 which is illustrated in discrete blocks. As seen from FIG. 1, the control circuit 100 includes arithmetic circuits 108 and 110. The arithmetic circuit 108 is designed for deriving a target tension to be exerted on the metal strip S in the heating zone 2 and the soaking zone 3. On the other hand, the arithmetic circuit 110 is designed for deriving a target tension to be exerted on the metal strip S in the moderate cooling zone 4 and the rapid cooling zone 5. The arithmetic cirucit 108 receives the temperature indicative sensor signals from the temperature sensors 104 in the heating zone 2 and the soaking zone. Furthermore, the arithmetic circuit 108 is connected to a manual input unit 112 to receive therefrom data indicative of proportion of the width (l) and thickness (d) of the metal strip S to be treated, which proportion may be hereafter referred to as "l/d value". Via the manual input unit 112, data are provided indicative of the line speed of the metal strip. The arithmetic circuit 110 receives the temperature indicative sensor signals from the temperature sensors 104 in the moderate cooling zone 4 and the zone 5. The arithmetic circuit 110 also receives the motor speed indicative signal from the motor speed sensor 106. Furthermore, the arithmetic circuit 108 is connected to a manual input unit 112 to receive therefrom data indicative of proportion of the width (l) and thickness (d) of the metal strip S to be treated, which proportion may be hereafter referred to as "l/d value". Via the manual input unit 112, data are provided indicative of the line speed of the metal strip.

Figure 3:
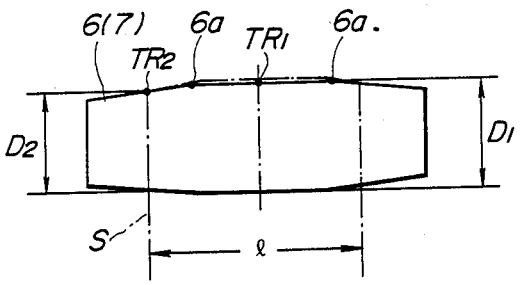
FIG. 3 is a front elevation of a hearth roll showing dimensions of the various sections thereof.

The arithmetic circuits 108 and 110 derive the target tensions for respectively associated zones on the basis of the input data. Basically, the target tension is determined in relation to the line speed of the metal strip in the furnace and to an assumed roll crown. As shown in FIG. 3, the hearth roll 6 is formed of a taper crown with a tapered periphery at both axial ends of the roll. In the construction shown in FIG. 3, the hearth roll 6 has a diameter $D_1$ at the axial center portion between points 6*a*–6*a* where taper periphery extends. As seen from FIG. 3, the hearth roll 6 has an axial length longer than the width of the metal strip. The heart roll has a diameter $D_2$ at a point $TR_2$ which corresponds to the lateral edge of the metal strip. In this term, the magnitude of effective crown Tc can be calculated by the following equation:

$$Tc = D_1(1+\alpha.\Delta T_1) - D_2(1+\alpha.\Delta T_2)$$

where $\alpha$ is a linear expansion coefficient;

$\Delta T_1 = TR_1 - TR_0$;

$TR_1$ is a temperature at the axial center of the hearth roll;

$TR_0$ is an initial temperature;

$\Delta T_2 = TR_2 - TR_0$; and $TR_2$ is a temperature of the roll at the point $TR_2$.

Figure 6:
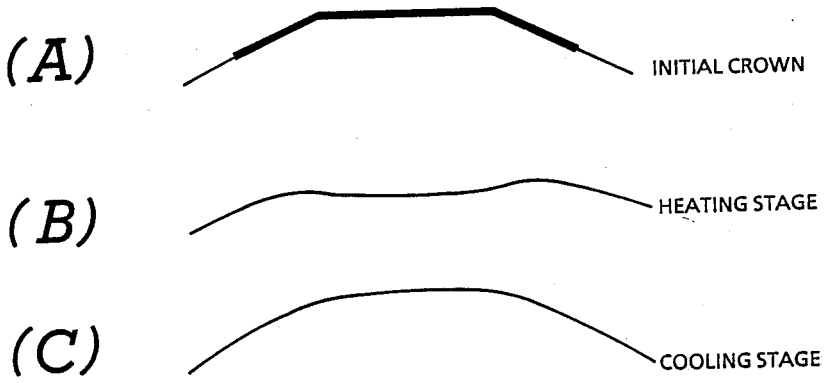

Here, as set forth above, the temperatures of various sections of the hearth roll 6 tend to be different from each other. Namely, at the hearth roll 6 in the heating zone 2 and the soaking zone 3, the central portion of the hearth roll is covered by and held in contact with the surface of the metal strip S to be heat-treated. Therefore, the temperature of the central portion of the hearth roll 6 is held at a value corresponding to the temperature of the metal strip S. On the other hand, at both axial end portions, the hearth roll is directly subjected to the heat in the heating zone. Therefore, the temperature at both axial ends substantially corresponds to the temperature of the heating and soaking zones, respectively. As a result, greater thermal expansion occurs at the axial end sections than that in the central portion. Therefore, the roll crown tends to be reduced from the initial configuration as shown in FIG. 6(A) to that shown in FIG. 6(B). Reduction of magnitude of the effective roll crown causes lowering of the centering force to be exerted on the metal strip to cause meandering.

On the other hand, when the hearth roll 6 is disposed within the moderate cooling zone 4 and the rapid cooling zone, the central portion is subjected to the relatively high temperature of the metal strip. On the other hand, the axial end portions are exposed to the cooling atmosphere. Therefore, the temperature at the central portion becomes higher than that at the axial end portions. Thermal expansion at the central portion becomes much greater than that at the axial end portions to cause a change of the effective roll crown to that shown in FIG. 6(C). Increasing the magnitude of the roll crown tends to cause heat buckling. Especially the possibility of causing heat buckling becomes much higher when the line speed is lowered.

Variation of magnitude of the effective crown also occurs depending upon change of the line speed. If the line speed is rapidly changed, the temperature of the metal strip S changes rapidly. Accordingly, the temperature at the central portion of the hearth roll 6 changes rapidly. On the other hand, the temperature of the atmosphere changes relatively moderately. Therefore, change of the temperatures at the axial end portions is relatively low. This also causes variation of thermal crown.

On the other hand, the tendency of the meandering and thermal buckling varies depending upon the proportion (l/d) of the metal strip to be annealed. Namely, when the l/d value is great, the possibility of causing thermal buckling is relatively high. On the other hand, when the l/d value is small, the possibility of causing meandering is relatively low and the possibility of causing thermal buckling is relatively high. On the other hand, when the l/d value is small, the possibility of causing meandering is high but the possibility of causing thermal buckling is low.

In order to prevent the metal strip from causing meandering and thermal buckling, the tension force to be exerted on the metal strip has to be appropriately controlled.

Figure 4:
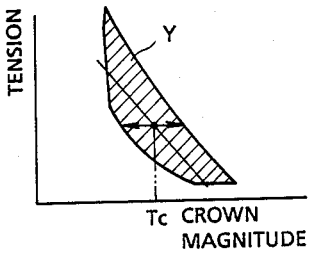
FIG. 4 is a graph showing relationship between an effective roll crown and a unit tension with respect to various metal strips having different proportions in width and thickness.

FIG. 4 shows the relationship between the effective roll crown magnitude and the unit tension to be exerted on the metal strips having different l/d values. In FIG. 4, the hatched range is considered as an optimal range for the actual and practical l/d value range of metal strips. Therefore, the tension control system set forth above controls the rotation speeds of the bridle rolls 8*a*, 9*a* and 10*a* and the hearth rolls 6 so that the tension force to be exerted on the metal strip can be maintained at this optimal range.

Figure 5:
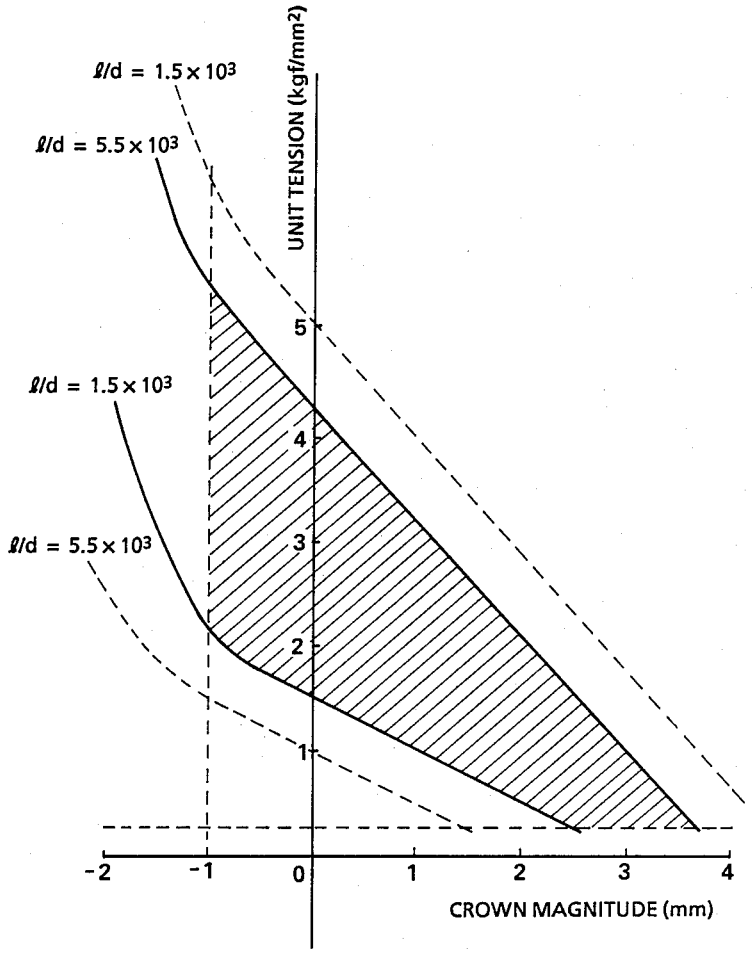
FIG. 5 is a chart showing optimal relationship between the effective roll crown and the tension force to be exerted on the low-carbon steel strip.

Here, the range of the l/d values of the metal strips to be practically used is between $l/d=1.5\times10^3$ and $l/d=5.5\times10^3$. As seen from FIG. 5, when the metal strip having the l/d value is $1.5\times10^3$ is to be annealed, the allowable maximum tension (kgf/mm$^2$) in relation to the effective crown magnitude (mm) is as shown by a line A, and allowable minimum tension is as shown in line B. On the other hand, when a metal strip having l/d value is $5.5\times10^3$ is to be annealed, the allowable maximum tension in relation to the effective crown magnitude is as shown by line C and the allowable minimum tension is as shown by line D. As seen herefrom, the allowable maximum tension of the metal strip having the l/d value of $1.5\times10^3$ (line A) is greater than the allowable maximum tension of the metal strip of the l/d value of $5.5\times10^3$ (line C). On the other hand, the allowable minimum tension (line D) of the metal strip of the l/d value of $5.5\times10^3$ is less than that (line B) of the metal strip of the l/d value of $1.5\times10^3$. Therefore, the hatched range is determined in a range defined by lines C and B.

It should be noted that the allowable minimum tension is determined in view of performance of the tension control apparatus, so that stable tension can be obtained.

Even when the Tc value is negative, there is some Tc value range where the total centering force becomes positional. In such a Tc value range, only a slightly greater tension force is required and excessive tension will make the operation inefficient. In this view, the Tc value of the optimal range is set at $-1$.

Returning to FIG. 1, a roll speed control circuit 113 is provided for controlling the revolution speed of the motor 13 which drives the bridle roll 9*a* of the intermediate bridle roll assembly 9. The roll speed control circuit 113 receives a roll speed reference which may be input through the manual input unit 112 and defines the basic rotation speed of the rolls. The roll speed control circuit 113 is also connected to the motor speed sensor 106 which monitors the revolution speed of the motor 13, to receive therefrom a motor speed indicative signal. The roll speed control circuit 113 compares the motor speed indicative signal value with the basic rotation speed reference value to adjust the drive signal voltage for adjusting the revolution speed of the motor 13 at the basic rotation speed as set.

The arithmetic circuit 108 and 110 receives the data indicative of the l/d value of the metal strip S to be annealed and the temperature indicative sensor signals from the temperature sensors 104*a*, 104*b*, 104*c* and 104*d* respectively disposed in the heating zone 2, the soaking zone 3, the moderate cooling zone 4 and the rapid cooling zone 3, the moderate cooling zone 4 and the rapid cooling zone 5. The arithmetic circuit 108 is also connected to the motor speed sensor 106 to receive therefrom the motor speed indicative signal indicative of the revolution speed of the motor 13. This motor speed indicative signal value serves as the line speed indicative data. The arithmetic circuits 108 and 110 also receives the driver signal output from the roller speed control circuit 113 as a signal indicative of the roll speed of the bridle roll 13. The arithmetic circuits 108 and 110 derive the assumed temperature of the central portion and axial end portions of the hearth rolls 6 in the heating zone 2 and the soaking zone 3 on the basis of the temperature indicative sensor signals from the temperature sensors 104*a* and 104*b* and the line speed of the metal strip S.

In practice, the relationship between the assumed temperature at the central portion and the axial end portions, the atmosphere temperature in the heating zone and soaking zone and the line speed may be experimentally derived, as set forth, since the temperature at the axial end portions of the hearth rolls in the heating zone and the soaking zone substantially correspond to the temperature of the atmosphere in the heating zone and the soaking zone. Therefore, assumption will be made that the temperature of the axial end portions corresponds to the temperature as indicated by the temperature indicative sensor signals. On the other hand, the temperature drop at the central portion relative to the atmosphere temperature may be variable depending upon the line speed of the metal strip S. The temperature drop may be experimentally derived in terms of the line speed.

On the basis of the assumed temperatures in the central portions and the axial end portions of the hearth rolls, the arithmetic circuit 108 derives the magnitude Tc of the effective roll crown on the hearth roll by the equation set forth above. Based on the effective roll crown magnitudes on the hearth rolls in the heating zone and soaking zone, the arithmetic circuit 108 determines the target tension so that the tension may be within the hatched region. Based on the derived target tension value, the arithmetic circuit 108 outputs a target tension indicative signal.

In practice, the effective crown magnitude may be directly derived by looking up a preset table in terms of the temperature indicative signal value and the line speed data. For enabling this, the effective crown table may be set in the arithmetic circuit 108, which table may be derived from experimentation.

Similarly, as set forth above, the temperature of the central portion of the hearth rolls 6 disposed in the moderate cooling zone 4 and the rapid cooling zone 5 substantially corresonds to that of the metal strip S traveling through the moderate cooling zone and the rapid cooling zone. On the other hand, even in the moderate cooling zone 4 and rapid cooling zone 5, the axial end portions of the hearth rolls 6 are exposed to the atmosphere. Therefore, the temperature in the axial end portions of the hearth rolls 6 is lower than that in the central portion. The magnitude of difference of the temperatures at the central portion and the axial end portions is variable depending upon the line speed. Therefore, the temperature at the central portion may be assumed on the basis of the line speed and the temperatures as indicated by the temperature indicative signals form the temperature sensor 104*c* and 104*d*. On the other hand, one may be able to assume the temperatures at the axial end portion of the hearth rolls 6 in the moderate cooling zone 4 and the rapid cooling zone are represented by the temperature indicative sensor signal values. Based on the assumed temperatures at the central portions and the axial end portions of the hearth rolls 6 in the moderate cooling zone and the rapid cooling zone, an effective crown magnitude is assumed by the arithmetic circuit 110. In order to derive the effective crown magnitude, a table to be looked-up in terms of the temperature indicative sensor signal value and the line speed may be set in the arithmetic circuit. The arithmetic circuit 110 thus derives the target tension so that the tension value is within the hatched area of FIG. 5 in terms of the assumed effective crown magnitude of the hearth rolls 6 in the moderate cooling zone 4 and the rapid cooling zone.

The arithmetic circuit 108 is connected to tension control circuits 114, 116 and 118. As will be seen from FIG. 1, the tension control circuit 114 is designed to determine a correction value for the rotation speed of the bridle roll 8*a* on the basis of the tension indicative sensor signal from the tension sensor 102*a* and the target tension as derived by the arithmetic circuit 108.

In practice, a correction value of the rotation speed of the bridle roll 8*a* is determined on the basis of the difference between the actually measured tension by the tension sensor 102*a* and the target tension. The tension control circuit 114 thus produces a correction signal indicative of the correction value of the rotation speed of the bridle roll 8*a*. The correction signal is fed to a roll speed control circuit 120. The roll speed control circuit 118 receives a basic roll speed reference signal which may be set through the manual input unit 112. The roll speed control circuit 120 derives the rotation speed of the bridle roll 8*a* of the basis of the roll speed reference signal value and the value of the correction signal input from the tension control circuit 114. Based on the derived rotation speed of the bridle roll, the roll speed control circuit 120 outputs a drive signal to the motor 12 for driving the latter at the controlled speed.

The arithmetic circuit 108 also feeds the target tension indicative signal to the tension control circuit 116. The tension control circuit 116 is designed to derive a correction value for controlling rotation speeds of the hearth rolls in the heating zone 2. For this purpose, the tension control circuit 116 is connected to a tension indicative sensor signal from the tension sensor 112*b*. Similarly to the foregoing, the tension control circuit 116 derives the correction value on the basis of the tension indictive sensor signal value and the target tension indicative value. The tension control circuit 116 feeds a correction signal indicative of the derived correction value to a roll speed control circuit 122. The roll speed control circuit 122 receives the roll speed reference signal and modifies the roll speed reference signal value with the correction signal value to derive a drive signal. The drive signal is fed to the motor 11 to control the revolution speed of the latter and thereby control the rotation speeds of the hearth rolls in the heating zone 2.

The target tension indicative signal of the arithmetic circuit 108 is also fed to the tension control circuit 118. Similarly to the foregoing tension control circuit 116, the tension control circuit 118 derives a correction value for the basic roll speed reference for adjusting the rotation speed of the hearth rolls 6 in the soaking zone 3. The tension control circuit 118 thus outputs a correction signal to a roll speed control circuit 124. The roll speed control circuit 124 thus outputs a driver signal for driving the motor 11 which drives the hearth rolls in the soaking zone 3. Therefore, the hearth rolls 6 in the soaking zone 3 are driven at the speed derived in the roll speed control circuit 124.

Similarly to the foregoing arithmetic circuit 108, the arithmetic circuit 110 is connected to tension control circuits 126, 128 and 130. The tension control circuit 126 thus receives the target tension indicative signal from the arithmetic circuit 110. The tension control circuit 126 is also connected to a tension sensor 102*d* to receive therefrom the tension indicative sensor signal. The tension control circuit 126 compares the tension indicative signal value with the target tension indicative signal value to derive a difference therebetween. Based on the derived difference, the tension control circuit derives a correction value to output a correction signal to a roll speed control circuit 132. The roll speed control circuit 132 is designed to receive the basic roll speed reference indicative signal. The roll speed control circuit 132 modifies the basic roll speed as represented by the basic roll speed reference indicative signal based on the correction signal from the tension control circuit. The roll speed control circuit 132 thus outputs a driver signal to the motor 11 which is designed to rotatingly drive the hearth rolls 6 in the moderate cooling zone 4. Therefore, the hearth rolls 6 in the moderate cooling zone 4 are driven at a speed as determined by the roller speed control circuit 132.

The arithmetic circuit 110 feeds the target tension indicative signal to the tension control circuit 128. The tension control circuit 128 is also connected to a tension sensor 102*e* to receive therefrom the tension indicative sensor signal. The tension control circuit 128 compares the tension indicative signal value with the target tension indicative signal value to derive a difference therebetween. Based on the derived difference, the tension control circuit 128 derives a correction value to output a correction signal to a roll speed control circuit 134. The roll speed control circuit 134 is designed to receive the basic roll speed reference indicative signal. The roll speed control circuit 134 modifies the basic roll speed as represented by the basic roll speed reference indicative signal based on the correction signal from the tension control circuit. The roll speed control circuit 134 thus outputs a driver signal to the motor 11 which is designed to rotatingly drive the hearth rolls 6 in the rapid cooling zone 5. Therefore, the hearth rolls 6 in the rapid cooling zone 5 are driven at the speed as determined by the roller speed control circuit 134.

The arithmetic circuit 110 further feeds the target tension indicative signal to the tension control circuit 130. The tension control circuit 130 is also connected to a tension sensor 102*f* to receive therefrom the tension indicative sensor signal. The tension control circuit 130 compares the tension indicative signal value with the target tension indicative signal value to derive a difference therebetween. Based on the derived difference, the tension control circuit 128 derives a correction value to output a correction signal to a roll speed control circuit 136. The roll speed control circuit 136 is designed to receive the basic roll speed reference indicative signal. The roll speed control circuit 136 modifies the basic roll speed as represented by the basic roll speed reference indicative signal based on the correction signal from the tension control circuit. The roll speed control circuit 136 thus outputs a driver signal to the motor 11 which is designed to rotatingly drive the bridle roll 10*a* of the bridle roll assembly 10. Therefore, the bridle roll 10*a* is thus driven at the speed as determined by the roller speed control circuit 136.

It should be appreciated that though the arithmetic circuits 108 and 110 are employed for deriving target tensions for a plurality of rolls, it would be, of course, possible to employ the arithmetic circuits for deriving target tensions for a respectively corresponding single roll. In addition, though only one motor speed sensor is employed in the shown embodiment, it would be possible to employ motor speed sensors for feedback controlling motor speeds for respective motors toward desired speeds as derived by the roll speed control circuits.

As will be appreciated herefrom, by adjusting the tension to be exerted on the metal strip S in terms of the effective crown magnitude on the hearth rolls in various heat-treatment stages in the annealing furnace, meandering and heat buckling of the metal strip can be effectively prevented.

Such tension control system may be applicable for annealing extra low carbon steel strip, such as strip for tin plate, TFS (tin-free strip) and so forth. As is well known, the extra low carbon steel, particularly that for very thin surface decorative plate, is classified depending upon required treatment and hardness into classes $T_1$ to $T_6$, for example, "T" indicates refining magnitude and the figure following "T" represents magnitude of hardness. In the shown example, the greater value of the figure represents a greater hardness of the strip.

Conventionally, the extra low carbon steel strip classified at T4 or above could be produced by means of the continuous annealing furnace. Namely, in case of the extra low carbon steel strip classified at T3 or below, this could not be produced because it was difficult to reduce the content of carbon to obtain required softness. On the other hand, the soft steel of T3 or below is often required to have non-aging characteristics. This also prevents such soft steel from being produced by a continuous annealing process.

In recent years, attempts have been made to produce such soft steel through a continuous annealing process. In this case, heat buckling tends to be a serious problem to be solved.

In addition, the extra low carbon steel strip has a higher recrystallization temperature than that of the low carbon steel strip and has lower hardness. The recrystallization temperature tends to be differentiated depending upon the content of Ti and/or Nb. Also, depending upon the Ti and Nb content, hardness of the metal strip tends to be varied. Namely, the metal strip which does not contain Ti and Nb has lower recrystallization temperature, e.g. 650° C. and has greater hardness than that containing Ti and/or Nb which has higher crystallization temperature, e.g. 750° C. On the other hand, the extra low carbon steel does not contain Ti and Nb cannot and has complete non-aging characteristics.

Figure 7:
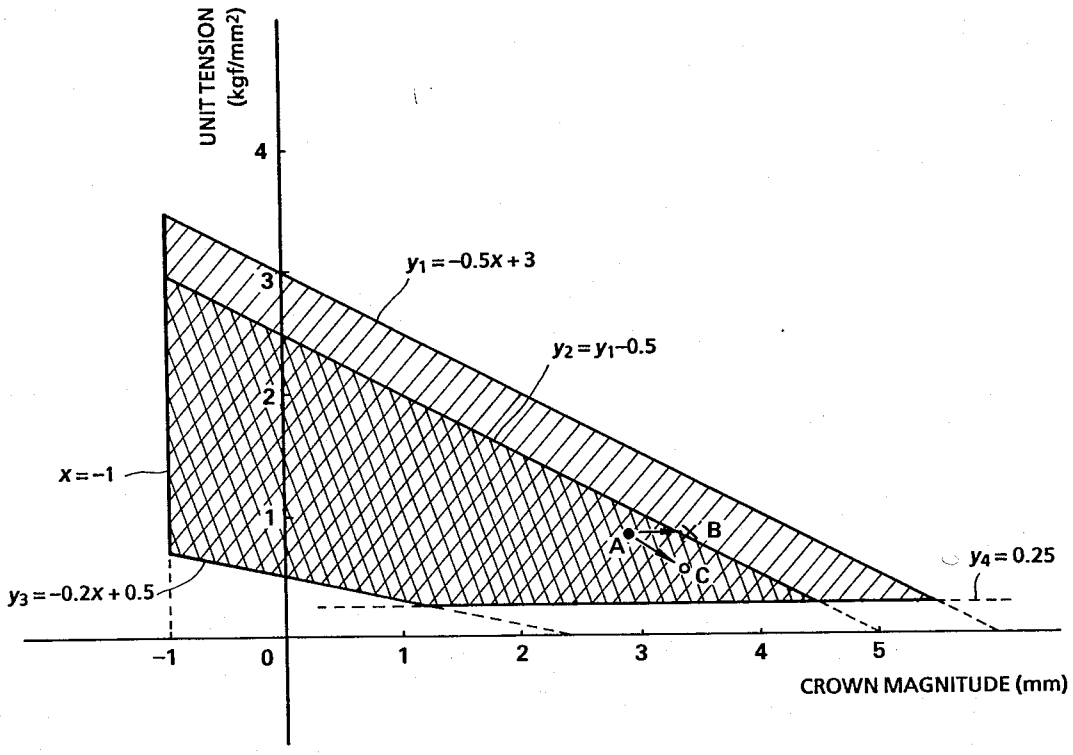
FIG. 7 is a graph showing the relationship of an actual roll crown and a unit tension in an experimentation for annealing extra low-carbon steel strips with various compositions.

The appended Table 1 shows typical examples of compositions of the extra low carbon steel produced through continuous annealing process. Various l/d values of metal strips having the composition as shown in Table 1 were annealed to find optimal tension values where heating bucking may not occur. In the experimentation, steel strips in a l/d value range of 1500 to 6700 were used. The result of experimentation is shown in FIG. 7. As will be apparent from FIG. 7, when steel strip not containing Ti and Nb is used, the border between causing and not causing heat bucking can be illustrated in terms of the relationship between the effective crown magnitude and the tension to be exerted on the metal strip, by:

$$y_1 = -0.5x + 3$$

in FIG. 7. On the other hand, when steel strip containing Ti or Nb is used, the border between causing and not causing heat bucking can be illustrated in terms of relationship between the effective crown magnitude and the tension to be exerted on the steel strip, by:

$$y_2 = y_1 - 0.5$$

On other hand, it was found that the relationship of the effective crown magnitude and the tension to be exerted on the metal strip so as not to cause meandering has no substantial difference between steel strips not containing Ti or Nb and those containing Ti and Nb. From the result, it was further found that in the region where the effective crown magnitude is relatively large, the border between causing and not causing meandering can be illustrated by:

$$y_4 = 0.25$$

On the other hand, in a region where the effective crown magnitude is relatively small, the border between causing and not causing meandering can be illustrated by:

$$y_3 = -0.2x + 0.5$$

On the other hand, minimum effective crown magnitude was set at $x < -1$. After experimentations, it was found that when the effective crown magnitude becomes smaller than $-1$, the centering force of the roll crown does not work and meandering of the metal strip could not be suppressed.

Therefore, as long as the effective crown magnitude and the tension can be maintained to be in the cross-hatched range in FIG. 7, heat buckling and meandering of the extra low carbon steel strip can be successfully prevented irrespective of the content of Ti and Nb. On the other hand, in case of annealing of the steel strip of the extra low carbon steel containing no Ti and Nb, the tension may be adjusted to be in a region defined by the lines $y_1$, $y_3$ and $x = -1$. In case of annealing of the steel strip containing Ti or Nb, the tension in relation to the effective crown magnitude is to be adjusted to be in a range defined by $y_2$, $y_3$ and $x = -1$.

EXAMPLE

Figure 8:
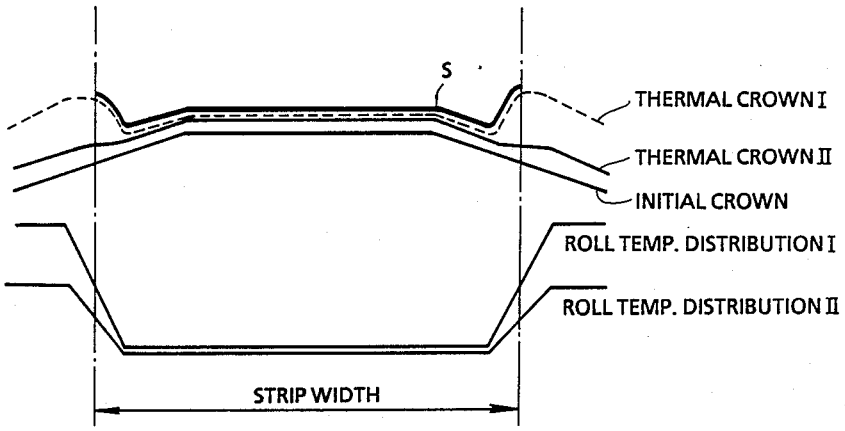
FIG. 8 is a chart showing variations of roll crown.
Figure 9:
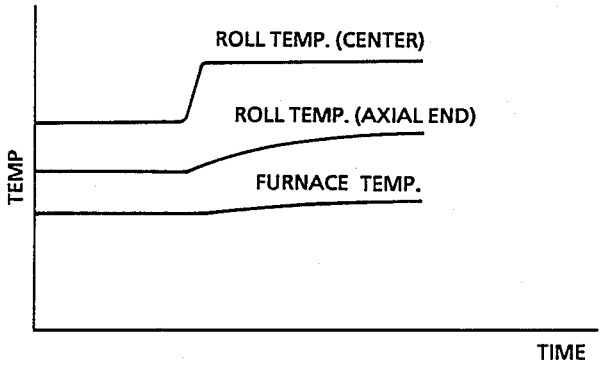
FIG. 9 is a graph showing variations of temperatures at various portions on the hearth roll.

In order to confirm the above-discussion, an example will be explained herebelow. In order to perform continuous annealing for the example, hearth rolls having the center diameter $D_1$ (=700 mm) and the axial end diameter $D_2$ (=699.7 mm) were used. In this case, the roll crown magnitude and tension varies as shown by A, B and C in FIG. 7. At the initial condition, the relationship between the roll crown and the tension is held within the region set forth above, as represented by point A. During annealing the temperature of various portions, i.e. the central portion and axial end portions of the hearth roll varies as shown in FIG. 9 to cause thermal expansion at different rate. This cases change of the roll crown as shown in FIG. 8. As will be seen from FIG. 8, magnitude of the roll crown varies depending upon the temperature distribution on the hearth roll. Therefore, due to difference of thermal expansion magnitude at the central portion and the axial end portions of the hearth roll, the effective crown magnitude varies to take the relationship between the effective crown magnitude and tension out of the region, as represented by point B. In order to compensate this, tension is adjusted to place the relationship between the crown magnitude and tension within the aforementioned desired region, as represented by the point C.

As will be appreciated herefrom, by appropriately adjusting the tension to be exerted, an extra low carbon steel strip can be produced through the continuous annealing process without causing heat buckling and/or meandering.

While the present invention has been disclosed in terms of the preferred embodiment in order to facilitate better understanding of the invention, it should be appreciated that the invention can be embodied in various ways without departing form the principle of the invention. Therefore, the invention should be understood to include all possible embodiments and modifications to the shown embodiments which can be embodied without departing form the principle of the invention set out in the appended claims.

TABLE 1

| | Extra Low-Carbon Steel (With Ti) | Extra Low-Carbon Steel (With Nb) | Extra Low-Carbon Steel (With no Ti and Nb) |
|---|---|---|---|
| C | 0.001 | 0.0010 ~ 0.0020 | 0.0020 |
| Si | 0.019 | 0.013 | 0.015 |

TABLE 1-continued

| | Extra Low-Carbon Steel (With Ti) | Extra Low-Carbon Steel (With Nb) | Extra Low-Carbon Steel (With no Ti and Nb) |
|---|---|---|---|
| Mn | 0.08 | 0.16 | 0.21 |
| P | 0.008 | 0.012 | 0.007 |
| S | 0.005 | 0.006 | 0.010 |
| Al | 0.053 | 0.038 | 0.039 |
| N | 0.0018 | 0.0019 | 0.0028 |
| Ti or Nb | 0.027 | 0.014 | — |

What is claimed is:

1. A system for controlling tension to be exerted on a metal strip in a continuous annealing furnace which includes a plurality of hearth rolls for defining a path for the metal strip, comprising:

tensioning means for exerting tension on said metal strip as it travels through said continuous annealing furnace along said path;

monitoring means for monitoring a preselected operation parameter of said annealing furnace, which operation parameter effects a variation of the magnitude of the effective roll crown on said hearth rolls;

crown deriving means for deriving an effective roll crown magnitude on the basis of said operation parameter as monitored; and tensioning deriving means for deriving an optimum tension range to be applied to the strip on the basis of said operation parameter and connected for controlling said tensioning means for adjusting the tension to be exerted on said metal strip so that the tension to be exerted on the metal strip is maintained within said optimum tension range.

2. A system as set forth in claim 1, wherein said tensioning means comprises first, second and third bridle rolls, said first bridle roll being arranged at the entrance of said annealing furnace, said second bridle roll being arranged at the outlet of said annealing furnace and said third bridle roll being disposed within said annealing furnace and on said metal strip path, said first, second and third bridle rolls being cooperative with each other for adjusting the tension to be exerted on said metal strip, and said tension deriving means being connected to control rotation speed of said bridle rolls for controlling the applied tension within said optimum tension range.

3. A system as set forth in claim 2, wherein said third bridle roll is driven at a predetermined speed and said tension deriving means adjusts the rotation speeds of said first and second bridle rolls in relation to the rotation speed of said third bridle roll for maintain said tension within said optimum tension range.

4. A system as set forth in claim 1, wherein said monitoring means is connected to monitor temperature within said annealing furnace as a parameter for causing thermal changes of said roll crown, and said crown deriving means is connected to temperature distribution on various sections of said hearth roll on the basis of the monitored temperature and the line speed of said metal strip for sensing thermal change of roll crown magnitude.

5. A system as set forth in claim 4, wherein said monitoring means further monitors the tension exerted on said metal strip traveling through said annealing furnace, said tension deriving means derives said optimum tension and compares criteria defining said optimum tension with said actual tension as monitored by said monitoring means for adjusting the rotation speed of said first and second bridle rolls based on the difference between said optimum tension range indicative criteria and said actual tension.

6. A system as set forth in claim 1, which further comprises driving means for rotatingly driving said hearth rolls, said tension deriving means being cooperative with said driving means for adjusting the tension of said metal strip within said optimum tension range in cooperation with said monitoring means.

7. A system as set forth in claim 6, wherein said driving means controls the rotation speed of the respective hearth rolls for adjusting the tension to be exerted on said metal strip.

8. A system as set forth in claim 3, wherein said monitoring means monitors the temperature within said annealing furnace as a parameter for causing thermal change of said roll crown, and said crown deriving means derives an assumed temperature distribution on various sections of said hearth roll on the basis of the monitored temperature and the line speed of said metal strip for controlling thermal change of roll crown magnitude.

9. A system as set forth in claim 4, wherein said monitoring means further monitors the actual tension exerted on said metal strip traveling through said annealing furnace, said tension deriving means derives said optimum tension and compares criteria defining said optimum tension with said actual tension as monitored by said monitoring means for adjusting the rotation speed of said first and second bridle rolls based on differences between said optimum tension range indicative criteria and said actual tension.

10. A system as set forth in claim 3, which further comprises drive means for rotatingly driving said hearth rolls, said tension deriving means being cooperative with said drive means for adjusting the tension of said metal strip within said optimum tension range in cooperation with said monitoring means.

11. A system as set forth in claim 10, wherein said drive means controls the rotation speed of the hearth rolls for adjusting the tension to be exerted on said metal strip.

12. A system as set forth in claim 1, wherein said tension deriving means derives said optimum tension range in relation to of the composition of said metal strip to be annealed.

13. A system as set forth in claim 12, wherein said tension deriving means derives said optimum tension range for annealing an extra low carbon steel strip in relation to the effective crown magnitude of said hearth roll in such a manner that, when tension to be exerted on the extra low carbon steel strip is y kg/mm$^2$ and the effective crown magnitude is x mm, the range is defined by lines illustrated by ($y_1=-0.5x+3$) and ($y_3=-0.2x+0.5$).

14. A system as set forth in claim 13, wherein said tension deriving means further defines said optimum tension range in relation to said effective crown magnitude of said hearth roll by criteria illustrated by ($y_4=0.25$) and ($x=-1$).

15. A system as set forth in claim 12, wherein said tension deriving means modifies said optimum tension range for annealing extra low carbon steel strip containing Ti or Nb to be defined by criteria illustrated by ($y_2=y_1-0.5$) and ($y_3=-0.2x+0.5$).

16. A system as set forth in claim 15, wherein said tension deriving means further defines said optimum tension range in relation to said effective crown magnitude of said hearth roll by criteria illustrated by ($y_4=0.25$) and ($x=-1$).

17. A system as set forth in claim 1, wherein said annealing furnace is divided into a heating stage and a cooling stage, said monitoring means monitors said operating parameters in said heating stage and cooling stage separately from each other, said crown deriving means derives the assumed effective roll crown magnitude of hearth rolls disposed in said heating stage and cooling stage separately from each other, and said tension deriving means controls the tension of the metal strip traveling in said heating stage and cooling stage independently of each other.

18. A system as set forth in claim 17, wherein said tensioning means comprises first, second and third bridle rolls, said first bridle roll being arranged at the entrance of said annealing furnace, said second bridle roll being arranged at the outlet of said annealing furnace and said third bridle roll being disposed within said annealing furnace and on said metal strip path, said first and third bridle rolls being cooperative with each other for adjusting the tension to be exerted on said metal strip in said heating stage and said second and third bridle rolls being cooperative to each other for adjusting the tension to be exerted on said metal strip in said cooling stage, and said tension deriving means being connected to control the rotation speeds of said first, second and third bridle rolls for adjusting the tension to a value within said optimum tension range.

19. A system as set forth in claim 18, wherein said third bridle roll is driven at a predetermined speed and said tension deriving means adjusts the rotation speeds of said first and second bridle rolls in relation to the rotation speed of said third bridle roll for maintaining said tension within said optimum tension range.

20. A system as set forth in claim 19, wherein said monitoring means monitors the temperature within said heating stage and said cooling stage in said annealing furnace separately from each other as parameters for causing thermal changes of said roll crown, and said crown deriving means derives an assumed temperature distribution on various sections of said hearth roll on the basis of the monitored temperature and the line speed of said metal strip for assuming thermal changes of roll crown magnitude.

21. A system as set forth in claim 20, wherein said monitoring means further monitors the actual tension exerted on said metal strip traveling through said heating stage and said cooling stage of said annealing furnace independently of each other, said tension deriving means derives said optimum tension range and compares criteria defining said optimum tension range with said actual tension as monitored by said monitoring means for adjusting the rotation speed of said first and second bridle rolls based on the difference between said optimum tension range indicative criteria and said actual tension.

22. A system as set forth in claim 21, which further comprises driving means for rotatingly driving said hearth rolls, and said tension deriving means is cooperative with said driving means for adjusting the tension of said metal strip within said optimum tension range in cooperation with said monitoring means.

23. A system as set forth in claim 22, wherein said driving means controls the rotation speed of the respective hearth rolls for adjusting the tension to be exerted on said metal strip.

24. A system for controlling tension of strip continuously moving in a continuous annealing furnace, which furnace includes a plurality of hearth rolls defining a path for the metal strip, comprising:

tensioning means for exerting tension on said metal strip traveling through said continuous annealing furnace along said path;

monitoring means for monitoring a preselected operation parameter of said annealing furnace, which operation parameter effects a variation of magnitude of effective roll crown on said hearth rolls;

crown deriving means for deriving an assumed effective roll crown magnitude on the basis of said operation parameter as monitored by said monitoring means;

tension deriving means for deriving an optimum tension range on the basis of said operation parameter and controlling said tension means for adjusting the tension exerted on said metal strip so that the tension exerted on the metal strip is maintained within said optimum tension range, said tension deriving means being connected for deriving said optimum tension range for annealing an extra low carbon steel strip in relation to the effective crown magnitude of said hearth roll in such a manner that, when the tension exerted on the extra low carbon steel strip is y kg/mm$^2$ and the effective crown magnitude is x mm, the range is defined by lines illustrated by ($y_1=0.5x+3$) and ($y_3=-0.2\times0.5$).

25. A system as set forth in claim 24, wherein said tension deriving means further defines said optimum tension range in relation to said effective crown magnitude of said hearth roll by criteria illustrated by ($y_4=0.25$) and ($x=-1$).

26. A system as set forth in claim 24, wherein said tension deriving means modifies said optimum tension range for annealing extra low carbon steel strip containing Ti or Nb to be defined by criteria illustrated by ($y_2=y_1-0.5$) and ($y_3=-0.2x+0.5$).

27. A system as set forth in claim 26, wherein said tension deriving means further defines said optimum tension range in relation to said effective crown magnitude of said hearth roll by criteria illustrated by ($y_4=0.25$) and ($x=-1$).

28. A method for controlling tension exerted on a metal strip in a continuous annealing furnace including a plurality of hearth rolls provided with a given magnitude of roll crown, comprising the steps of:

providing bridle rolls along the path of said metal strip;

driving said bridle rolls at controlled speeds for exerting tension on said metal strip in said annealing furnace, the magnitude of which tension exerted on said metal strip being determined depending upon a difference of rotation speeds of said bridle rolls;

monitoring a furnace operation parameter which affects the effective magnitude of said roll crown;

deriving an assumed effective roll crown magnitude on the basis of the monitored operation parameter;

deriving a target tension to be exerted on said metal strip so that said tension to be exerted on said metal strip is maintained within a predetermined relationship with the assumed roll crown magnitude; and controlling the rotation speed of said bridle rolls for adjusting the tension to be exerted on said metal strip toward said target tension.

29. A method as set forth in claim 28, which further comprises the step of monitoring the actual tension exerted on said metal strip, and said control of rotation speed of said bridle rolls is performed on the basis of a difference between said actual tension and said target tension.

30. A method as set forth in claim 28, wherein the rotation speed of said respective bridle rolls is determined with reference to a predetermined one of said bridle rolls.

31. A method as set forth in claim 30, wherein, in said step of monitoring said operation parameter, there are monitored the temperature of the atmosphere in said annealing furnace and the line speed of said metal strip, and said assumed roll crown magnitude is derived on the basis of the monitored temperature and said line speed.

32. A method as set forth in claim 32, wherein said target tension for annealing an extra low carbon steel strip is determined in relation to the assumed effective roll crown magnitude in such a manner that, when tension to be exerted on the extral low carbon steel strip is y kg/mm$^2$ and effective crown magnitude is x mm, the range is defined by lines illustrated by ($y_1=-0.5x+3$) and ($y_3=-0.2x+0.5$).

33. A method as set forth in claim 32, wherein said tension deriving means further defines said optimum tension range in relation to said effective crown magnitude of said hearth roll by criteria illustrated by ($y_4=0.25$) and ($x=-1$).

34. A method as set forth in claim 32, wherein said tension deriving means modifies said optimum tension range for annealing extra low carbon steel strip containing Ti or Nb to be defined by criteria illustrated by ($y_2=y_1-0.5$) and ($y_3=-0.2x+0.5$).

35. A method as set forth in claim 34, wherein said tension deriving means further defines said optimum tension range in relation to said effective crown magnitude of said hearth roll by criteria illustrated by ($y_4=0.25$) and ($x=-1$).

* * * * *